United States Patent [19]

Jessick

[11] Patent Number: 4,709,763

[45] Date of Patent: Dec. 1, 1987

[54] SELF-ACTIVATING FIRE EXTINGUISHER

[75] Inventor: James Jessick, Franklin Township, Gloucester County, N.J.

[73] Assignee: Future Fire Suppression, Inc., Franklinville, N.J.

[21] Appl. No.: 14,720

[22] Filed: Feb. 13, 1987

[51] Int. Cl.[4] ..... A62C 35/02

[52] U.S. Cl. ..... 169/26

[58] Field of Search ..... 169/26, 36; 169/35, 169/58, 57

[56] References Cited

U.S. PATENT DOCUMENTS 1,932,291 10/1933 Prefontaine ..... 169/36

3,132,695 5/1964 Peltier ..... 169/26

FOREIGN PATENT DOCUMENTS 2110740 6/1972 France ..... 169/26

*Primary Examiner*—Jeffrey V. Nase

*Assistant Examiner*—James M. Kannofsky

*Attorney, Agent, or Firm*—Norman E. Lehrer

[57] ABSTRACT

A self-activating fire extinguisher which is particularly useful as a Christmas tree ornament is comprised of a thin-walled sealed glass container having a quantity of a fire extinguishing liquid such as Halon 2402 contained therein. When in the vicinity of a fire, the temperature of the liquid will rise causing it to boil which increases the pressure within the container. Eventually the container will break, releasing the liquid; the fumes from which extinguish the fire. In order to prevent glass fragments from being thrown about when the container breaks, the majority of the container is coated with a plastic material. This material adheres to the glass and maintains the broken pieces of glass together even at high temperatures. The liquid and fumes are released through a small portion of the container that is not coated by the plastic.

10 Claims, 5 Drawing Figures

SELF-ACTIVATING FIRE EXTINGUISHER

BACKGROUND OF THE INVENTION

The present invention is directed toward a self-activating fire extinguisher and more particularly toward such a device which includes a frangible package having a quantity of a fire extinguishing liquid therein which is dispersed when the package breaks at an elevated temperature.

Fire extinguishers have been known in the past which utilize a liquid within a container wherein the container bursts as a result of increased internal pressure created by the heat from a fire in order to release the liquid. Reference is made to such prior extinguishers in U.S. Pat. No. 2,857,971. While the details of such devices are not known, it is assumed that a protective cover or the like must be provided around the container in order to prevent injuries when the container explodes. Providing such covers would, undoubtedly, increase the cost of such extinguishers.

The foregoing problem becomes even more serious when it is desired to use the more modern fire extinguishing fluids which are currently available such as Halon. It is known that these materials must be contained in an airtight container in order to preserve the effectiveness thereof. Since fire extinguishers must sometimes be kept many years before the fluid is utilized, it has been determined that the best type of container for these materials is glass. Should such an extinguisher explode, however, the flying glass can create a serious danger.

Prior U.S. Pat. Nos. 3,843,525 and 3,918,526 show an example of a fire extinguisher which includes a glass cylinder which is filled with a fire extinguishing solution. Although the cylinder is provided with a cover, the cover is apparently made of a combustible plastic. According to the patent, the container bursts into small pieces as a direct result of the heat created by the burning cover. Thus, the cover does not provide protection for the fragments of broken glass.

While the present invention has many uses, it is particularly suited for the manufacture of self-activating fire extinguishers which can also function as Christmas tree ornaments. In connection with such use, it is important that glass fragments not be thrown about when the extinguisher is activated. To Applicant's knowledge, no one has ever proposed to utilize an exploding-type fire extinguisher as an ornament for a Christmas tree.

Insofar as Applicant is aware, only one proposal has been made in the past to combine a fire extinguisher with a Christmas tree ornament. This combination is shown in U.S. Pat. No. 2,522,020. However, the device shown in this patent is relatively complex and utilizes a mechanical actuator to release the fire extinguishing liquid from the ornament. The ornament does not break as a result of the ornament or the fluid contained therein being heated.

SUMMARY OF THE INVENTION

The present invention is designed to overcome all of the deficiencies of the prior art discussed above. The self-activating fire extinguisher of the present invention is particularly useful as a Christmas tree ornament or the like and is comprised of a thin-walled sealed glass container having a quantity of a fire extinguishing liquid such as Halon 2402 contained therein. When in the vicinity of a fire, the temperature of the liquid will rise causing it to boil which increases the pressure within the container. Eventually the container will break, releasing the liquid; the fumes from which extinguish the fire. In order to prevent glass fragments from being thrown about when the container breaks, the majority of the container is coated with a plastic material. This material adheres to the glass and maintains the broken pieces of glass together even at high temperatures. The liquid and fumes are released through a small portion of the container that is not coated by the plastic.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
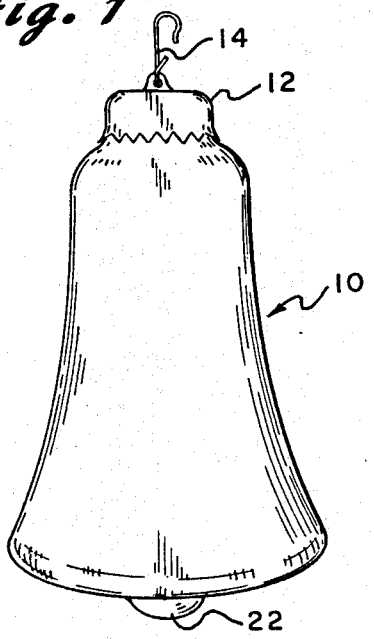
FIG. 1 is a self-activating fire extinguisher in the form of a Christmas tree ornament constructed in accordance with the principles of the present invention.
Figure 5:
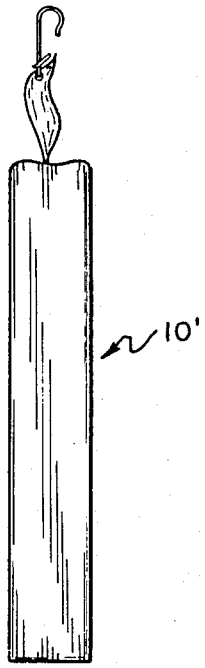
FIG. 5 is a perspective view of another alternate embodiment of the device shown in FIG. 1.

Referring now to the drawings in detail wherein like numerals have been used throughout the various figures to designate like elements, there is shown in FIG. 1 a self-activating fire extinguisher constructed in accordance with the principles of the present invention and designated generally as 10. Because of the construction of the present invention, it is particularly well suited to be used as an ornament for a Christmas tree. It is well known that many house fires are started by Christmas trees catching on fire. A plurality of fire extinguishers 10 hanging on a Christmas tree can extinguish the fire before it spreads. It is for this reason that the extinguisher 10 shown in FIG. 1 is made in the shape of a bell. This is, of course, by way of example only since the device can also be made in various other shapes such as the candle 10' shown in FIG. 5 or in substantially any other ornamental shape. As should be readily apparent to those skilled in the art, the extinguisher of the present invention need not be limited to a Christmas tree ornament but may take various other shapes and have various other uses.

The bell-shaped fire extinguisher 10 has a metal cap 12 secured by epoxy or the like to the top thereof. A wire hook 14 is attached to the cap 12 for suspending the extinguisher from a support such as a Christmas tree.

Figure 2:
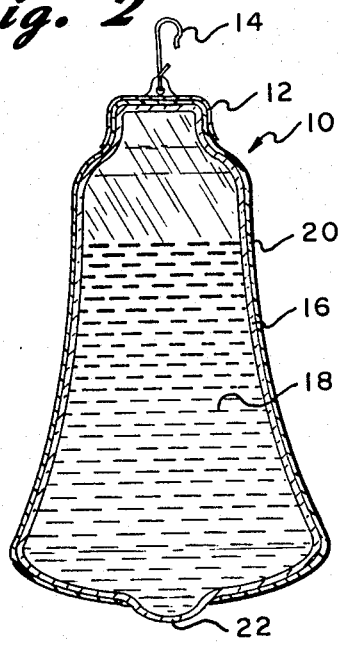
FIG. 2 is a cross-sectional view of FIG. 1.

As shown most clearly in FIG. 2, the extinguisher 10 is comprised essentially of a thin-walled glass container 16 which is totally closed and sealed from the outside atmosphere. A quantity of a fire extinguishing liquid 18 is within the container 16. Preferably the container will be approximately three-quarters filled with the liquid 18.

The preferred fire extinguishing liquid 18 is Halon 2402 which is available through Montedison USA, Inc. of New York, N.Y.; the chemical composition of which, according to the supplier, is 1.2 dibromo-1.1.2.2. tetrafluoroethane. Halon 2402 has a relatively low boiling point of approximately 47.3° C. When converted into a gaseous state, the fumes are denser than air whereby they tend to settle downwardly and are capable of extinguishing a fire from the source thereof by displacing oxygen.

A thin but substantially flexible plastic material 20 coats substantially the entire outer surface of the glass container 16 and firmly adheres thereto. The plastic coating 20 is capable of substantially maintaining its shape and physical characteristics and of adhering to the glass container 16 at a temperature above the boiling point of the liquid 18 and above the temperature which is needed for the boiling liquid to cause the container 16 to shatter. As a result, in the event that the glass container 16 breaks from internal pressure, glass fragments will not be thrown about but will be held substantially in place by the plastic coating 16.

A preferred plastic coating is available through Wheaton Plasti-Cote of Mays Landing, N.J. under the trademark "Second Skin." This is a polyvinyl chloride plastic material comprised of 62.5 percent of a high molecular weight resin; 35.5 percent plasticizers including dye-iso-decly Phthatate and epoxicised soybean oil and 2 percent stabilizer comprised of barium, cadmium and zinc. The "Second Skin" plastic material adheres to the glass and retains substantially all of its physical properties to a temperature of several hundred degrees centigrade; well above the boiling point of the liquid 18.

The plastic material 20 is applied to the outer surface of the container 16 by dipping or spraying or other known techniques. After the entire outer surface is coated, a portion of the plastic coating is removed so that at least one portion of the outer surface of the glass container will be devoid of the plastic coating. In the embodiment of the invention shown in FIGS. 2 and 3, a small circular portion 22 adjacent the bottom of the bell-shaped extinguisher 10 has had the plastic coating 20 removed therefrom. If this is done by grinding or sanding, the glass wall of the container 16 at this point can also be thinned such as shown in FIG. 2 so that this portion 22 is more frangible than the remaining portions of the glass container.

Figure 3:
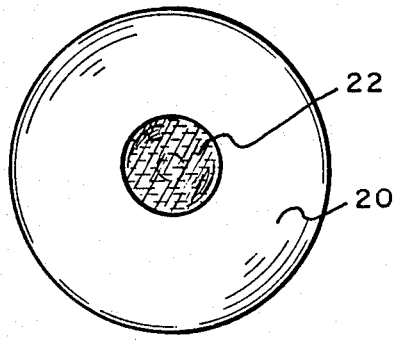
FIG. 3 is a bottom view of the extinguisher shown in FIGS. 1 and 2.

In lieu of removing the circular portion of the coating as shown in FIGS. 2 and 3, it is also possible to remove only a thin line of the coating such as by scoring the coating after it has been applied. This thin line can be circular or substantially any other configuration.

The self-activating fire extinguisher 10 functions in the following manner. The device 10 is suspended from a support such as a Christmas tree or the like utilizing the hook 14. In the event of a fire, the temperature of the liquid 18 rises and the same begins to boil thereby increasing the pressure within the container. Eventually the pressure within the container becomes great enough to cause at least a portion of the glass container 16 to shatter. Since the portion 22 is more frangible than the remaining portions of the glass container. This portion should shatter first. In the event that the remaining portions of the glass container 16 shatter, however, the plastic coating 20 will retain the glass fragments in place. The liquid and fumes from within the container 16 will escape substantially only through the opening caused by the breaking of the portion 22. The fumes will settle downwardly over the tree towards the floor and will extinguish the fire causing the heat.

Figure 4:
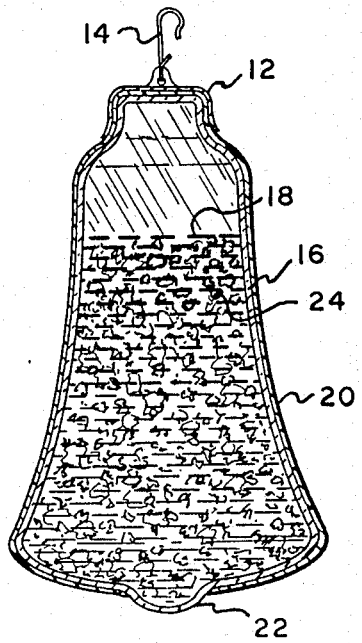
FIG. 4 is a view similar to FIG. 2 showing an alternate embodiment thereof.

In the embodiment of the invention shown in FIG. 4, particulate matter such as gas cracklings or other absorbent material 24 may also be included within the container 16. The particulate matter 24 will absorb a substantial portion of the liquid 18. When the glass container 16 breaks as a result of a fire, the particulate matter 24 carrying the liquid 18 will fall from the container and will tend to adhere to different parts of the Christmas tree as the particles fall. The fumes will then be released from the particulate matter thereby more broadly and evenly spreading the fumes in order to extinguish the fire.

The present invention may be embodied in other specific forms without departing from the spirit or essential attributes thereof and accordingly reference should be made to the appended claims rather than to the foregoing specification as indicating the scope of the invention.

I claim:

1. A self-activating fire extinguisher comprising:

a glass container having an outer surface, said container being totally closed and sealed from the outside atmosphere;

a quantity of a fire extinguishing liquid within said container, said liquid having a relatively low boiling point and, when converted into a gaseous state, having fumes which are denser than air whereby said fumes tend to settle downwardly and are capable of extinguishing a fire;

a thin but substantially flexible plastic material coating substantially the entire outer surface of said glass container and adhering thereto, said plastic coating being capable of substantially maintaining its shape and physical characteristics and of adhering to said glass container at a temperature above the boiling point of said liquid and above the temperature which is needed for the boiling liquid in said container to cause said container to shatter;

at least one portion of the outer surface of said glass container being devoid of said plastic coating;

whereby, in the event of a fire, the temperature of the liquid within said container rises and the same begins to boil thereby increasing the pressure within the container until at least a portion of the glass shatters, said plastic coating substantially maintaining the shape of said container so that said liquid and the fumes therefrom escape substantially only at that portion of the glass container which is not coated by said plastic.

2. The invention as claimed in claim 1 wherein that portion of the container not coated by said plastic coating is more frangible than the remaining parts of said container.

3. The invention as claimed in claim 2 wherein the thickness of said glass is less at said portion than at the remaining parts of said container.

4. The invention as claimed in claim 1 wherein said liquid has a boiling point below approximately 65° C.

5. The invention as claimed in claim 1 further including a quantity of particulate matter within said container capable of absorbing at least a portion of said liquid.

6. The invention as claimed in claim 1 wherein said plastic coating is colored.

7. The invention as claimed in claim 1 further including means connected to said container for suspending the same from a support.

8. The invention as claimed in claim 7 wherein said container is in the shape of a Christmas tree ornament.

9. The invention as claimed in claim 8 wherein said container is in the shape of a bell.

10. The invention as claimed in claim 1 wherein said plastic coating is comprised of polyvinyl chloride.

* * * * *